United States Patent [19]

Medenbach

[11] Patent Number: 4,904,975

[45] Date of Patent: Feb. 27, 1990

[54] COIL FORMER FOR A HIGH-VOLTGE TRANSFORMER

[75] Inventor: Gernot Medenbach, Braunfels, Fed. Rep. of Germany

[73] Assignee: U.S. Philips Corporation, New York, N.Y.

[21] Appl. No.: 297,819

[22] Filed: Jan. 13, 1989

[30] Foreign Application Priority Data

Jan. 19, 1988 [DE] Fed. Rep. of Germany ..... 38013347

[51] Int. Cl.[4] ..... H01F 15/10; H01F 27/30

[52] U.S. Cl. ..... 336/192; 29/605; 242/118.41; 336/185; 336/208

[58] Field of Search ..... 242/118.4, 118.41; 29/602.1, 605, 606; 336/192, 198, 208, 185; 310/71, 194, 215

[56] References Cited

U.S. PATENT DOCUMENTS 4,352,079 9/1982 Mueller et al. ..... 336/192 X

*Primary Examiner*—Thomas J. Kozma

*Attorney, Agent, or Firm*—Bernard Tiegerman

[57] ABSTRACT

Axially adjacently arranged winding chambers (3, 4, 5) for high-voltage coil sections are separated from one another on a central hollow body (9) by flanges (10, 11, 12, 13), the connection ends (24, 25) of the coil sections being guided to connection pins (7, 8) on a connection strip (6). The flanges (11, 12 13) have passage slots (21) which extend from winding chamber to winding chamber. Over the hollow body (9) there is arranged an additional wall member (15) which extends parallel to a wall of the body and from the remotest winding chamber (3) to the connection strip (6) and which forms, in conjunction with the body, a wire guiding gap (16) which is open at the side of the connection strip (6) as well as at one of its longitudinal sides, the flanges (11, 12, 13) also being slotted in the prolongation of the open wire guiding gap (16).

2 Claims, 3 Drawing Sheets

COIL FORMER FOR A HIGH-VOLTGE TRANSFORMER

BACKGROUND OF THE INVENTION

The invention relates to a coil former for a high-voltage transformer, having winding chambers for high-voltage coil sections axially adjacently arranged on a central hollow body and separated from one another by flanges. The coil sections have connection ends which are guided to connection pins on a connection strip, the flanges being provided with passage slots which extend from winding chamber to winding chamber.

Transformer coil formers of this kind are known, for example from DE-A- 2 655 607. Using a plurality of winding chambers for high-voltage coil sections, the high voltage is stepped down and breaking down of the insulation and hence short-circuiting are prevented. The passage slots enable the winding wire to be pulled from one chamber to another in the coil former. However, full mechanization of the winding of a coil on such a transformer coil former is difficult to achieve. This is because a feed wire must be pulled from the remotest winding chamber as far as the connection strip. This wire must be suitably insulated in order to prevent a breakdown between this wire and the winding wire in the winding chambers along which it is guided. Such increased insulation could be realized, for example by fitting an insulating sleeve around the wire. However, such an operation must be done by hand.

SUMMARY OF THE INVENTION

It is an object of the invention to dispense with additional insulation of winding wire sections guided along winding chambers carrying different potentials.

An additional wall member which extends parallel to a wall of the hollow body is arranged over the body from the remotest high-voltage winding chamber to the connection strip. In conjunction with the body this wall member forms, a wire guiding gap which is open at the side of the contact strip as well as at one of its longitudinal sides, the flanges also being slotted in the prolongation of the open wire guiding gap.

The mounting of the additional wall member on the hollow body so that a gap is formed in which the winding wire is guided along the winding chambers offers adequate insulation between this winding wire section and the individual windings in the winding chambers. Because the gap thus formed is open at a side which extends in the longitudinal direction of the coil former, in the non-wound state of the coil former the winding wire can be pulled from the connection strip as far as the remotest winding chamber by a winding finger. The entire winding process can thus be fully mechanized.

In a further version of the invention, the coil sections are wound on the coil former in that a wire guide guides the winding wire from a connection pin along the open longitudinal side of the wire guiding gap until it reaches the remotest winding chamber for high-voltage coil sections after which the full length of winding wire thus taken up is slid into the inlet gap by the wire guide, after which the remotest winding chamber for high-voltage coil sections is fully wound, and so on from one winding chamber to the next until the connection strip is reached. Coil former and winding process are thus adapted to one another so that a coil can be wound on the high-voltage coil former body in a plurality of chambers in one operation from the beginning till the end of the wire.

DETAILED DESCRIPTION OF THE PREFERRED EMBODIMENTS

Figure 1:
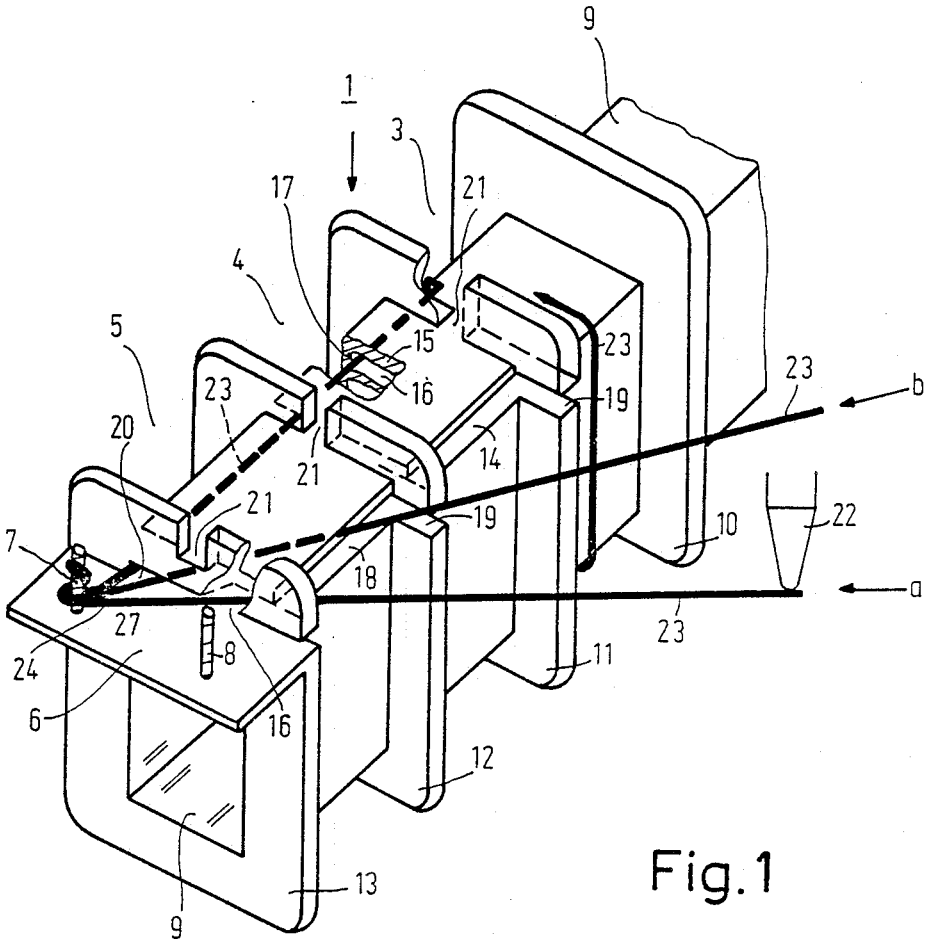
FIG. 1 shows a coil former for a mains transformer comprising several winding chambers for high-voltage coil sections and a laterally open wire guiding gap at the start of winding.

The coil former 1 shown in FIG. 1 serves as a coil former for a high-voltage transformer which preferably operates in a switched mode. At the high-voltage side the high-voltage transformer comprises three winding chambers 3, 4, 5, the chamber 5 adjoining a contact strip 6 on which connection pins 7, 8 are provided. The low-voltage side of the coil former is only partly shown, because the winding chamber at this low-voltage side has no special features.

The coil former 1 comprises a square hollow body 9 on which the flanges 10, 11, 12 are successively arranged in the axial direction at a distance from one another. Together with the body 9 the flanges 11 and 12 form the winding chamber 3, the flanges 11 and 12 forming the winding chamber 4 in conjunction with the body 9, while the flanges 12 and 13 form the winding chamber 5 in conjunction with the body 9.

At the area of the winding chambers 4 and 5 an additional wall member 15 is arranged parallel to a wall 14 of the hollow body 9, which additional wall member forms a wire guiding gap 16 in conjunction with the wall 14, which gap is closed by means of a connection portion 17 at the left-hand side of the coil former (viewed in the drawing), the gap being open at the area 18 at the right-hand side. At the area of the opening 18 of the gap the flanges 11, 12 and 13 are provided with slots 19 which extend in the prolongation of the gap 16 at the right-hand side of the coil former, so that a winding wire can be introduced into the open gap from the right-hand side of the coil former. The wire guiding gap 16 is also open at the area 20 at the side of the connection strip 6. The coil flanges 11, 12 and 13 are also provided with passage slots 21 wherethrough the winding wire can be guided as will be described hereinafter.

The winding of coil sections on the coil former 1 can be mechanized in that a winding finger 22 can wind the winding wire 23, a first end 24 of which is fastened to the connection pin 7, onto the coil former 1 without interruptions imposed by insulation procedures until the second end 25 of the winding wire is ultimately fastened to the connection pin 8. FIG. 1 shows the winding wire in three different positions. After the fastening of the first end 24 to the connection pin 7, the winding finger 22 first pulls the winding wire 23 away from the coil former 1 at an angle, a small part of the wire 23 already being pulled into the gap 16. The position of the wire is denoted by the arrow a. When the winding wire has been taken up over a distance corresponding to the distance between said connection pin and the remotest winding chamber 3 of the high-voltage section, the winding finger 22 slides the winding wire 23 into the wire guiding gap 16, via the position denoted by the arrow b, until the winding wire 23 occupies the position in the wire guiding gap 16 which is denoted by a broken line. The winding of a coil section in the winding chamber 3 then commences.

Figure 2:
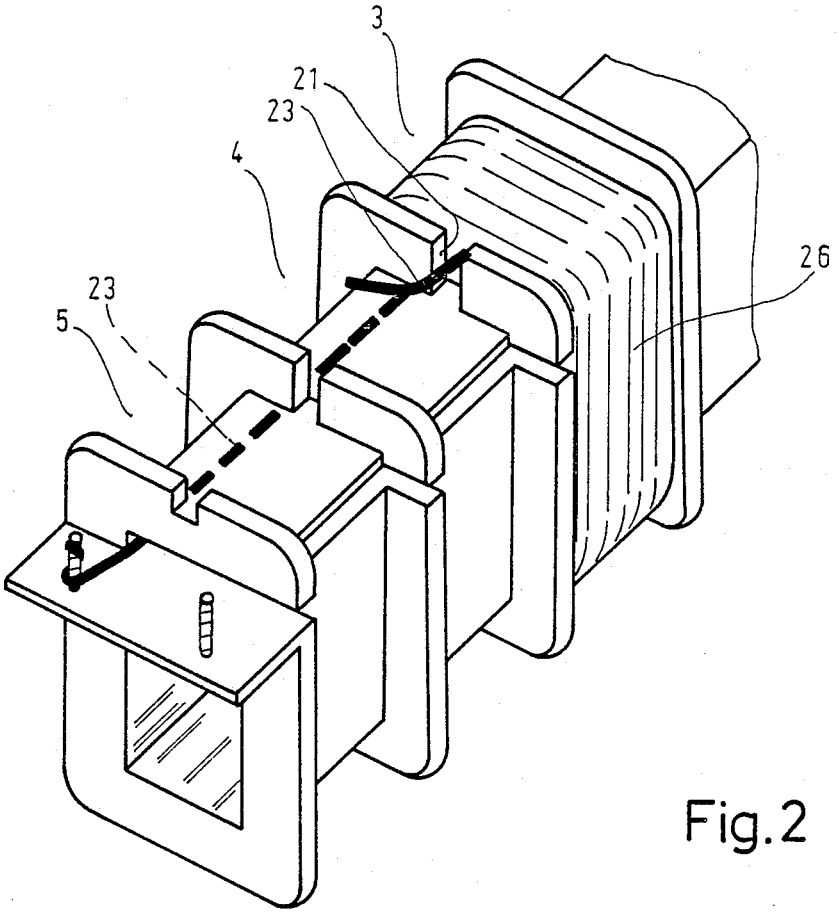
FIG. 2 shows the coil former of FIG. 1 with a wound winding chamber, this first wound chamber being situated furthest from the connection strip.

FIG. 2 shows the fully wound winding chamber 3 and the coil section 26 wound therein. The wire guide 22 subsequently guides the winding wire 23 to the winding chamber 4 via the passage slot 21 in the flange 11. A second coil section is thus wound in the winding chamber 4 and subsequently also a third coil section in the winding chamber 5 in a similar fashion.

Figure 3:
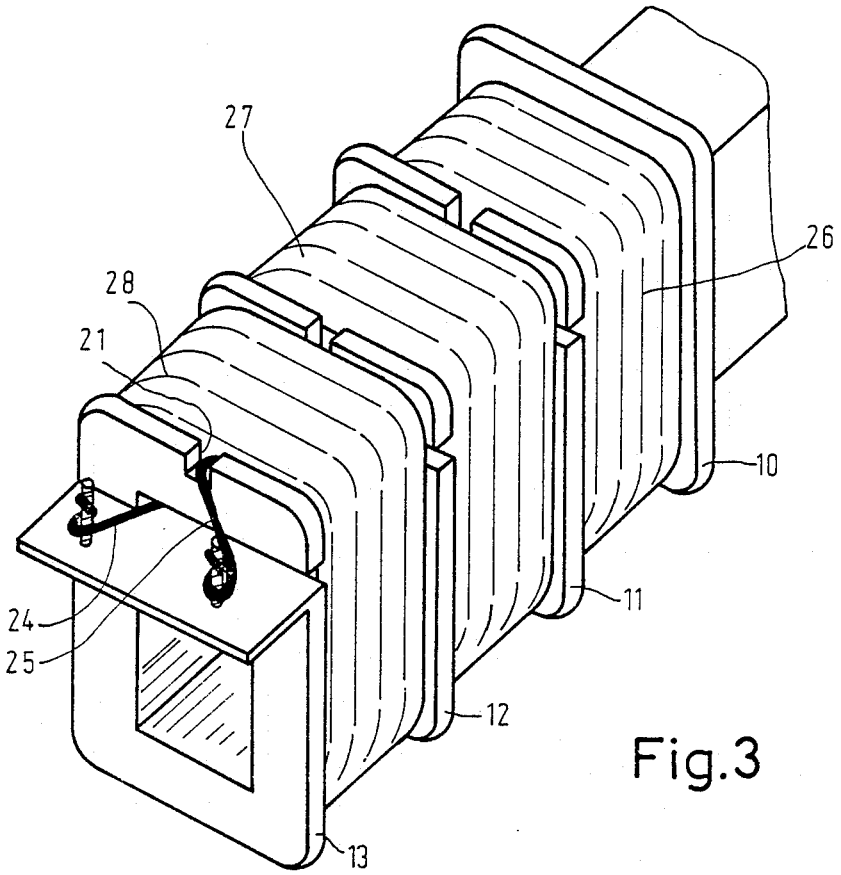
FIG. 3 shows the fully wound coil former with the second winding wire end wrapped around a connection pin.

FIG. 3 shows the coil former provided with the coil sections 26, 27 and 28, which are isolated from one another in a high-voltage sense. The end 25 of the winding wire is fastened to the connection pin 8 via the passage slot 21 in the flange 13. This winding procedure does not require any special insulation for any winding wire section. The breakdown strength of the high-voltage section of the transformer thus wound is adequate.

I claim:

1. A coil former for a high voltage transformer comprising: a hollow central body; winding chambers axially arranged on the central body; flanges which separate the winding chambers, the flanges being provided with passage slots which extend from winding chamber to winding chamber; and connection pins on a connection strip at one end of said body; further comprising, as an improvement, an additional wall member disposed over the hollow body which extends parallel to a wall of said body from a remotest winding chamber at the other end of said body to the connection strip and which forms, in conjunction with said body, a wire guiding gap which is opened at a side of the connection strip and at on one of its longitudinal sides; and wherein the flanges are slotted in a prolongation of the open wire guiding gap.

2. A method of winding coil sections comprising the steps of:

(1) providing a coil former which includes a hollow central body, winding chambers axially arranged on the central body, flanges which separate the winding chambers, the flanges being provided with passage slots which extend from winding chamber to winding chamber, connection pins on a connection strip at one end of said body, an additional wall member disposed over the hollow body which extends parallel to a wall of said body from a remotest winding chamber at the other end of said body to the connection strip and which forms, in conjunction with said body, a wire guiding gap which is opened at a side of the connection strip and at on one of its longitudinal sides, and wherein the flanges are slotted in a prolongation of the open wire guiding gap, and further providing a wire guide;

(2) then deploying a winding wire with the wire guide from one of the connection pins along the open longitudinal side of the wire guiding gap until it reaches the most remote winding chamber;

(3) then sliding the full length of the winding wire thus deployed into the gap with the wire guide;

(4) then fully winding the most remote winding chamber; and (5) then winding in successive winding chambers until the connection strip is reached.

* * * * *